United States Patent [19]

Blanpain et al.

[11] 4,358,224

[45] Nov. 9, 1982

[54] CONTINUOUS SLIDING SUPPORT GANTRY FOR A LARGE PASSAGE

[75] Inventors: Guy Blanpain, Verneuil-en-Halatte; Pierre Grandfils, Precy-sur-Oise, both of France

[73] Assignee: Charbonnages de France, Paris, France

[21] Appl. No.: 166,399

[22] Filed: Jul. 7, 1980

[30] Foreign Application Priority Data

Jul. 6, 1979 [FR] France ..... 79 17589

[51] Int. Cl.[3] ..... E21D 15/34

[52] U.S. Cl. ..... 405/298; 405/291

[58] Field of Search ..... 405/290, 291, 298, 299, 405/288; 299/31, 33

[56] References Cited

U.S. PATENT DOCUMENTS

| | | | |
|---|---|---|---|
| 2,826,898 | 3/1958 | Joy | 405/298 |
| 3,115,754 | 12/1963 | Joseph | 405/299 X |
| 4,189,258 | 2/1980 | Maykemper et al. | 405/291 |

FOREIGN PATENT DOCUMENTS

| | | | |
|---|---|---|---|
| 1127842 | 4/1962 | Fed. Rep. of Germany | 405/298 |
| 1139084 | 11/1962 | Fed. Rep. of Germany | 405/298 |
| 1154424 | 9/1963 | Fed. Rep. of Germany . | |
| 1171859 | 6/1964 | Fed. Rep. of Germany | 405/298 |
| 1257721 | 1/1968 | Fed. Rep. of Germany . | |
| 2363487 | 7/1975 | Fed. Rep. of Germany . | |
| 1230215 | 9/1960 | France | 405/290 |
| 1313514 | 11/1962 | France . | |
| 2339057 | 8/1977 | France . | |
| 2356809 | 1/1978 | France . | |
| 2415720 | 8/1979 | France | 405/298 |
| 984790 | 3/1965 | United Kingdom . | |
| 1037912 | 8/1966 | United Kingdom . | |
| 1159961 | 7/1969 | United Kingdom . | |

*Primary Examiner*—Dennis L. Taylor

*Attorney, Agent, or Firm*—Cushman, Darby & Cushman

[57] ABSTRACT

A gantry support for supporting a roof of a passage includes two parallel supporting units each having a lower frame provided with articulated tracks and an upper frame carried by props and two cross-members. The two cross-members carry an intermediate upper frame in the form of a beam which is slidable on guide elements and adapted to be clamped to the roof by small jacks. As the support advances the beam remains clamped against the roof of the passage until the beam reaches an end stop. The small jack is then released and the beam slidably advanced along the guide elements by means of a further jack.

11 Claims, 13 Drawing Figures

CONTINUOUS SLIDING SUPPORT GANTRY FOR A LARGE PASSAGE

BACKGROUND OF THE INVENTION

The present invention relates to a roof support in the form of a gantry for supporting a roof of a passage and advanceable along a floor of such passage.

Various types of supports are known, in which a supporting unit comprises frames provided with articulated tracks which are clamped on the roof and floor of mine workings or the like. Such supports are propelled either by their own means or by hauling or pushing on an anchoring means.

A support of this kind is described in particular in U.S. Pat. No. 4,129,990.

Supports are also described in U.S. Pat. No. 4,109,473.

These supports must be installed relatively close to one another in order to withstand the ground pressures to which they are subjected. Consequently they do not permit the easy circulation of equipment, and still less easily the passage of machines.

An object of the present invention is to provide a support which can be used in particular in headings and which permits the passage of machines by leaving clear a large surface on the floor, that is to say the "wall" in mining parlance. Another object of the present invention is to simplify the construction of upper frames by reducing and even eliminating the frames. Yet another object of the present invention is to facilitate continuous sliding of the support in an arched gallery, with or without supporting frames. These objects must be achieved at the same time as good support is provided for the roof, in order to protect personnel and equipment against accidents caused by roof falls.

SUMMARY OF THE INVENTION

According to the present invention there is provided a roof support in the form of a gantry for supporting a roof of a passage and advanceable along a floor of such passage, the support comprising:

(a) at least three parallel upper frames including two lateral frames and at least one intermediate frame, at least one of which frames comprises a straight beam;

(b) at least two lower frames each provided with an articulated track;

(c) jack means operable to clamp at least one of the upper frames against the roof of the passage;

(d) means for transmitting advancing forces of the support from the lower frames to the upper frames;

(e) at least two cross-members extending between the lateral frames and carrying the upper frames;

(f) guide means carried by the cross-members and supporting the at least one beam for slidable displacement thereof longitudinally of the support; and (g) means for sliding the at least one beam.

In this way good support is obtained and, when the support is advanced, the beam or beams remains or remain applied against the roof and slide on the guide means without forming an obstacle to the advance because metal-on-rock friction has been replaced by metal-on-metal friction.

It is not necessary for the guide means to be continuous, and it may simply comprise aligned elements carried by the cross-members.

In order to permit the advance of the beam or beams which has or have reached a stop end on the guide means, the latter are mounted so as to be adjustable by being pushed apart on the cross-members. If the lateral upper frames are tracked frames, the intermediate upper frame or frames will thus be released during the short space of time necessary for advancing the guide or guides supporting it or them. For this purpose each longitudinal guide may be carried by the cross-members with the aid of a push-rod operated by a jack and having its end joined to the guide by a spherical articulation.

Great flexibility of utilisation and good adaptation to irregularities of the roof are thus obtained.

In one economical embodiment of the invention all the upper frames comprise straight beams mounted for sliding and adapted to be driven in a sliding movement, each on a longitudinal slide guide carried by the cross-members.

However, if it is desired to obtain continuous supporting, the means pushing the slide guides apart on the supports are controlled in dependence on one another in such a manner that at least one of two successive upper frames will at all times be clamped by thrust against the roof.

In this way, continuous supporting is obtained, in which each of the straight beams is released, by itself or at the same time as others, while for preference about half of all the beams remain clamped and bearing against the roof. Each release of a beam is then followed by an advance of one step, after which it may be reclamped against the roof. While thus obtaining permanent clamping against the roof, the beams are advanced step by step, but not all at the same time, by sliding metal-on-metal, each beam on its respective guide and without friction against the rock forming the roof, or against the supporting frames if any are installed in the gallery.

For an arched roof it is advantageous for the cross-members to be transversely arched.

In a general way, it is advantageous for an odd number of upper frames to be provided, thus making it possible to effect symmetrical release of either only the even numbered upper frames or alternately the even numbered and odd numbered upper frames.

The invention is also applicable to a double gantry support comprising two single gantries aligned one behind the other and coupled together through the intermediate upper frames being common to both gantries and that at least one element of the guide means is carried by one of the cross-members of each gantry. The intermediate upper frame or frames in the form of beams which, in conjunction with their respective guides and with their operating jacks, constitute coupling members.

The present invention also extends to an upper frame comprising a straight beam mounted on an elongate guide and means for slidably displacing the straight beam on the guide.

BRIEF DESCRIPTION OF THE DRAWINGS

Embodiments of the present invention will now be described by way of example and with reference to the accompanying drawings in which.

DESCRIPTION OF THE PREFERRED EMBODIMENTS

Figure 1:
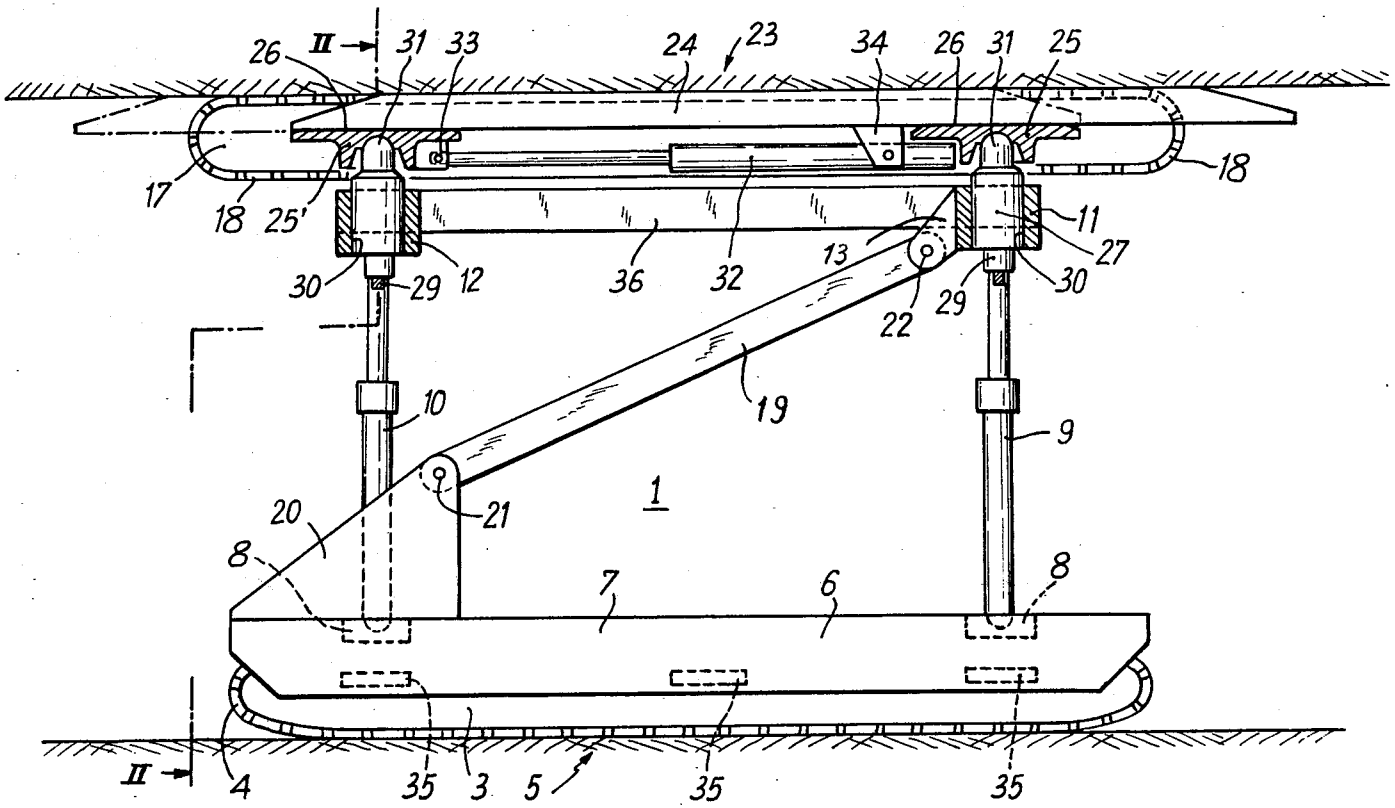
FIGS. 1 and 2 are respectively a view in longitudinal section on line I—I and a rear view, partly in section on line II—II, of a gantry support embodying the present invention.

A gantry support comprises two parallel supporting units 1 and 2 respectively, each of which comprises a lower frame 5 comprising frame members 3 having rounded ends enclosed directly by an articulated track 4 mounted so as to be guided by friction, the frame members 3 being straddled, as is known per se, by a stirrup 6 comprising two side plates 7 and two cross-members 8. The stirrup 6 is joined to the frame members 3 by cross-members 35. Each of the two cross-members 8 carries respectively a front pivotally mounted prop 9 and a rear pivotally mounted prop 10. The two front props of the two supporting units 1 and 2 each carry one end of a cross-member 11. The two rear props of the two supporting units 1 and 2 each similarly carry one end of another cross-member 12. Each of the ends of the cross-members 11 and 12 carries two longitudinal plates 13 spaced apart from one another and forming with them a stirrup 14, at the upper end of which are provided cross-members 15 for an upper frame 16 comprising frame members 17 having rounded ends and an articulated track 18 mounted for guiding by friction. Each end of the cross-members 11 and 12 thus constitutes a frame support. Each of the two supporting units is provided in addition with a plane connecting rod 19 fixed at its lower end, towards the rear, to a pivotal articulation 21 having a transverse axis and supported on two vertical plates 20 extending upwards from side plates 7. The rod 19 is also fixed at its upper end, towards the front, to a pivotal articulation 22 having a transverse axis and supported on the two plates 13 below the end of the cross-member 11.

It can be seen that the gantry support described comprises two lower frames 5 and two upper frames 16, connected together transversely by the two cross-members 11 and 12, and that the connecting rods 19 make it possible to transmit to the upper frames the advancing forces applied to the lower frames 5, from left to right in FIG. 1.

The two cross-members 11 and 12 carry at their middle a single upper frame 23 comprising a straight longitudinal box girder 24 supported by the two cross-members 11 and 12, as will be explained. The girder 24 is supported by two supports 25 provided with slide guides 26, the two slide guides 26 being aligned longitudinally. Each slide guide support 25 is in turn supported by a spherical articulation 31 on the end of a vertical push-rod 27 adapted to slide in a central vertical casing 30 of the cross-member 11 or 12, in which it can be pushed upwards by a vertical jack 28 making a short stroke. The jack 28 is supported on a bracket 29 situated under the cross-member 11 or 12 and the two cross-members 11 and 12 are coupled by two longitudinal members 36.

The girder 24 is bevelled at its front and rear in order to slide under the roof without catching. When the four props 9 and 10 are clamped to the roof, which is their normal position whenever they are used for sliding supporting, the small vertical jacks 28 can be tightened or released. If they are tightened, the girder 24 is clamped to the roof, between the roof itself, that is to say the rock, and the two slide guides 26. The coefficient of friction being higher between metal and rock than between metal and metal, any advance of the gantry support gives rise to relative slipping of the girder 24, which tends to remain behind as shown in broken lines in FIG. 1. Temporary slackening of the small vertical jacks 28 makes it possible to detach the girder 24 from the roof and to return it to the position shown in solid lines by simple sliding on the slide guides 26. Although the girder 24 can be returned manually, it is preferable to provide a horizontal return jack 32, of which one end 33 is connected to the rear support 25' of the slide guide 26, while the other end is connected to a bottom member 34 of the girder 24, the member 34 being at such a distance from the front end of the girder that when the latter is as far forward as possible the member 34 and/or that end of the jack 32 which is connected to it do not reach, or only just reach, the front support 25 of the slide guide 26. The temporary elimination of the support by the beam 24 acting as an upper frame is only a slight inconvenience, because during the operation of return of this central upper frame the remainder of the supporting gantry is clamped motionless and therefore does not give rise to local changes of ground pressure. The return time for the central upper frame is so short that there is then no observable effect of convergence of ground.

Figure 2:
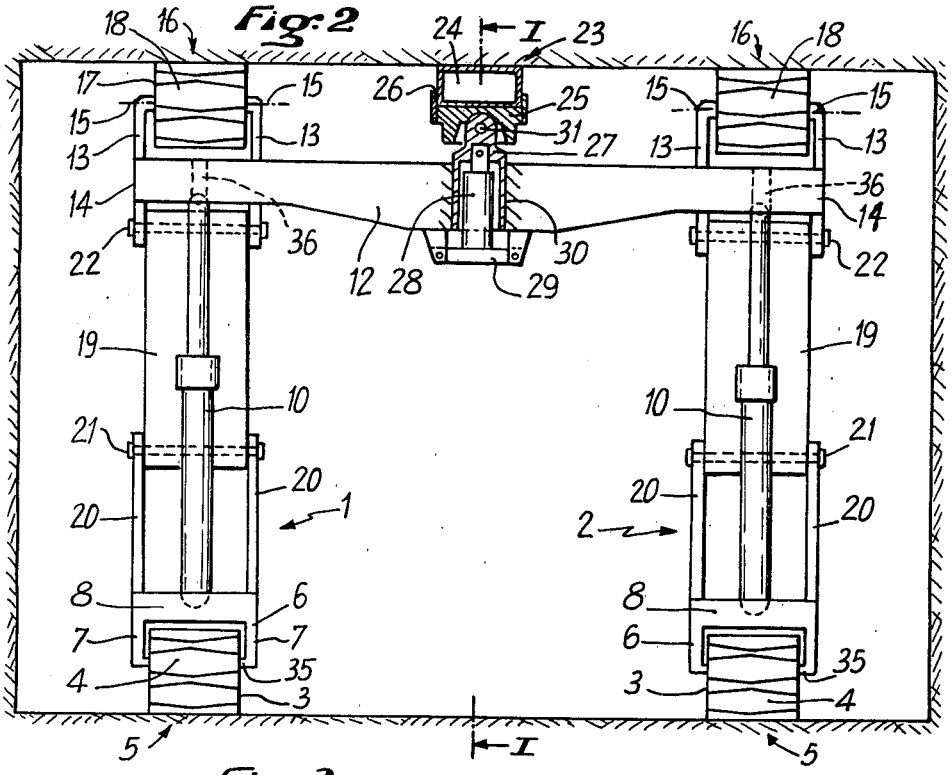
Figure 3:
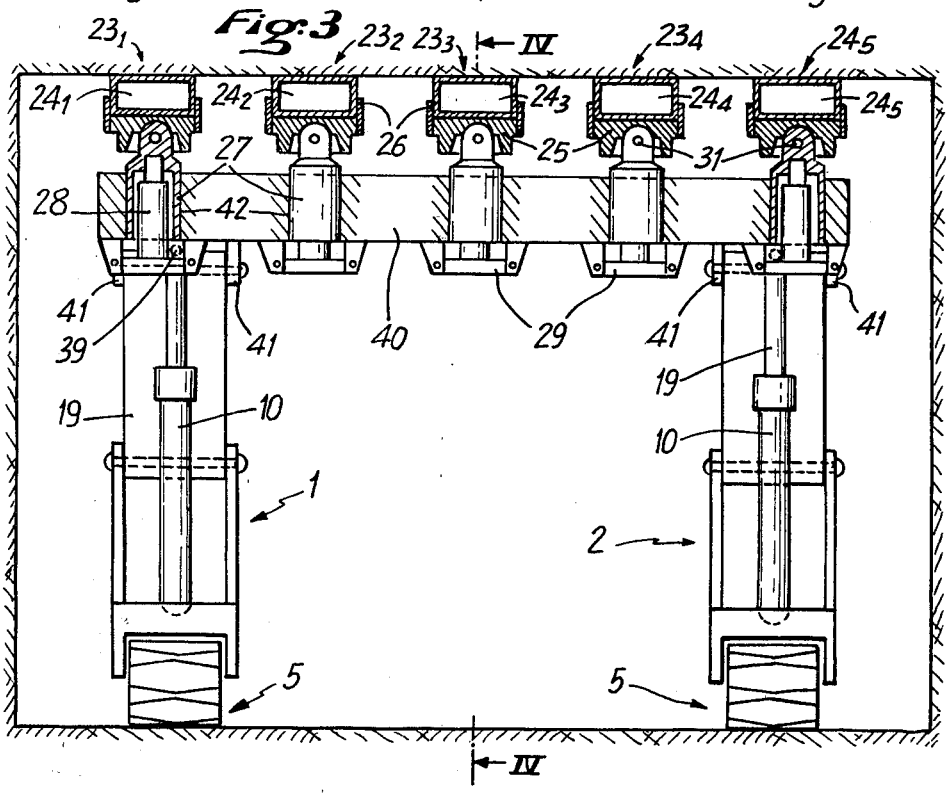
FIGS. 3 and 4 are corresponding views of a second embodiment of the present invention.
Figure 4:
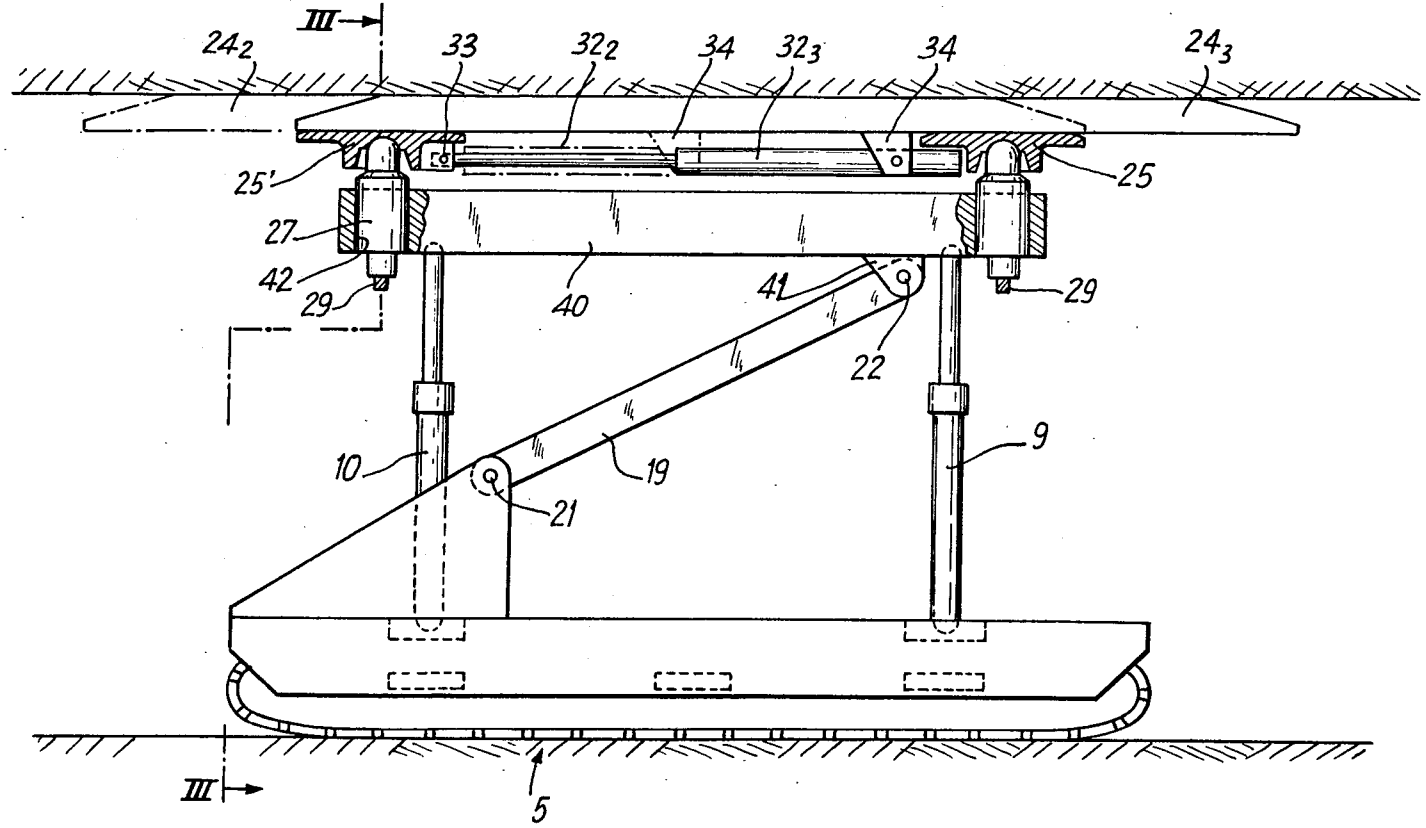

FIGS. 3 and 4 illustrate another embodiment of the present invention, having the same reference numerals for parts common to both it and to the support shown in FIGS. 1 and 2. All the lower parts and all the intermediate parts are identical to those of the gantry support shown in FIGS. 1 and 2. There are however five upper frames, all comprising beams $23_1$ to $23_5$. In order to support these upper frames, the four props 9 and 10 together carry by an articulation 39 a plate 40 on which are arranged two transverse alignments of five supports 25 and 25' of slide guides 26, these supports being aligned longitudinally in pairs and the transverse alignments of the supports 25 and 25' being offset longitudinally in relation to the respective transverse alignments of the props 9 and props 10. In a similar manner to the embodiment shown in FIGS. 1 and 2, each support 25 of a slide guide 26 is in turn supported by a spherical articulation 31 which is supported by the end of a vertical push rod 27 which can slide in a vertical casing 42 of the plate 40. In order to provide bearings for the pivotal connection 22 of the upper portion of the connecting rod 19, two pairs of plates 41 extend downwards from the plate 40.

When the lower frames 5 advance, the girders 24 of five upper frames 23, all of which are clamped by their associated jacks 28, remain behind until the end stop is reached, as illustrated in broken lines in FIG. 4. At that moment the upper frames can be released one by one and by means of the jacks $32_1$ to $32_5$ the girders $24_1$ to $24_5$ can each in turn be returned to the forward position shown in solid lines in FIG. 4, in which the upper frames are immediately re-clamped. Automatic control may also be provided for hydraulic circuits operating the associated jacks 28, so as to return in a first phase all the odd numbered girders, $24_1$, $24_3$ and $24_5$, which is the overall situation shown in FIG. 4, and then to return the even numbered girders $24_2$ and $24_4$, after the reclamping of the odd numbered upper frames. Alternate sliding of the upper frames is thus achieved. All the upper frames support the roof load as long as none of them has reached the end position, and when some of them are released in order to return them, the others support the load under favourable conditions, because at that moment the gantry support is stationary.

Figure 5:
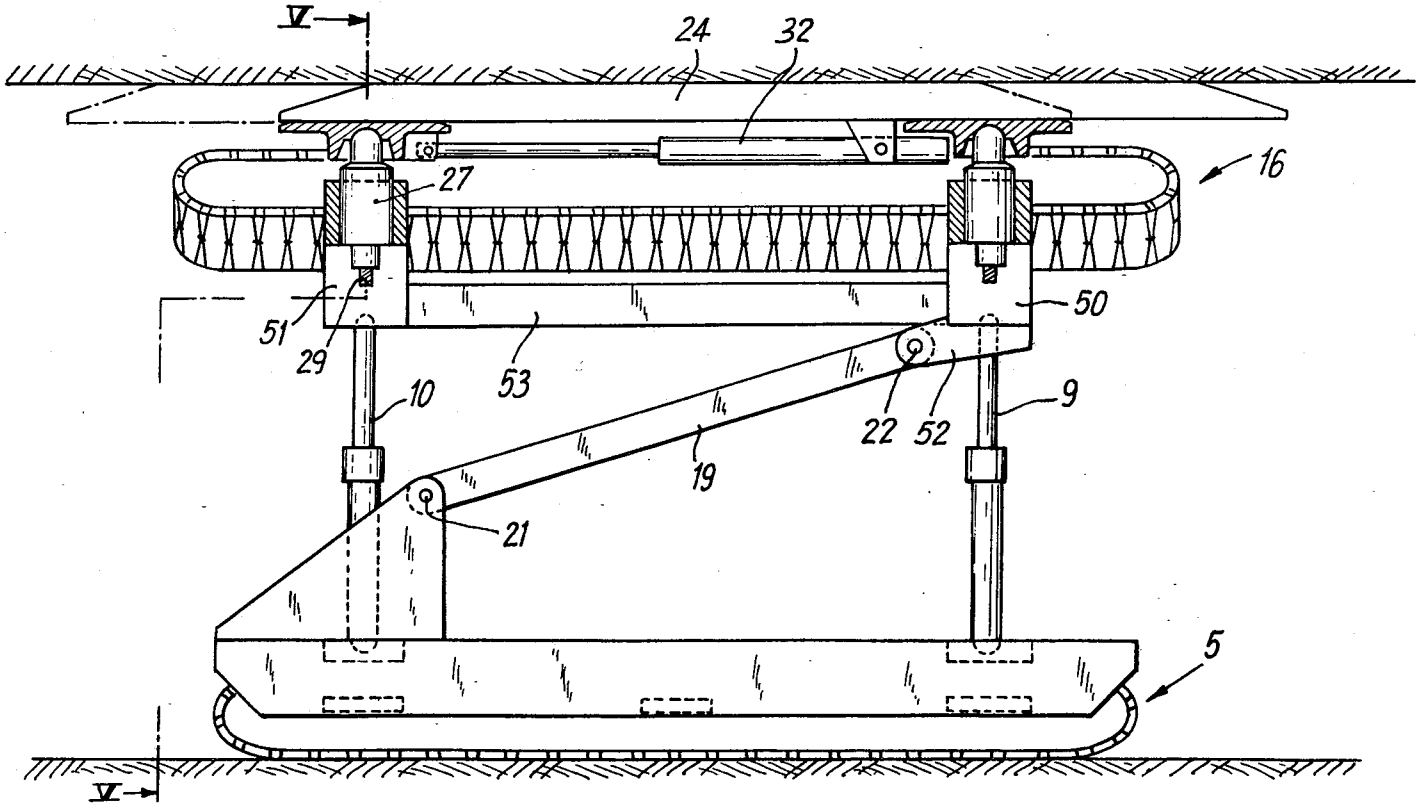
FIGS. 5 and 6 are corresponding views of a third embodiment of the present invention for arched galleries.
Figure 6:
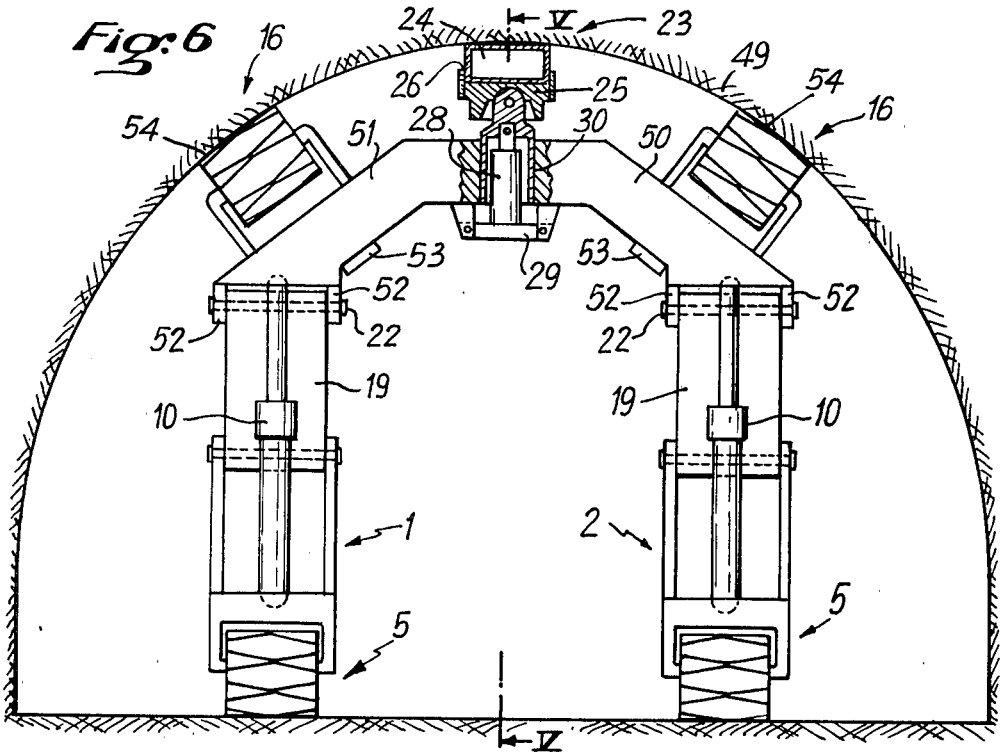

In a third embodiment of the present invention, which is illustrated in FIGS. 5 and 6, the general structure seen is in conformity with that of FIGS. 1 and 2, except that the cross-members 12 are replaced by arched cross-members 50, 51 for a gallery in the form of an arch 49. These arched cross-members carry, on an inclined portion substantially vertically in line with each of the supporting units 1 and 2, supports for the articulated track frames 16, whose support face 54 is similarly inclined. The arched cross-member 50 at the front has at each of its ends pairs of supports 52 for the pivotal articulations 22 of the connecting rods 19. Two longitudinal members 53 connect the two cross-members 50, 51 together longitudinally. The mode of utilisation of the gantry support of FIGS. 5 and 6 is identical to that of FIGS. 1 and 2.

Figure 8:
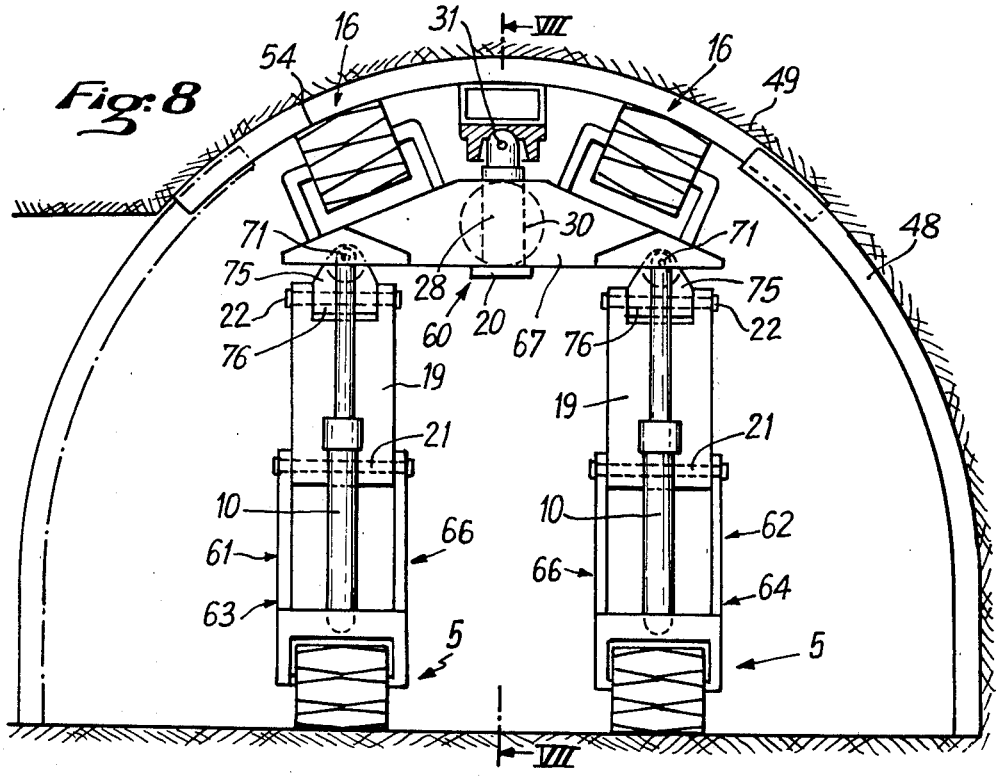
FIGS. 7 and 8 are respectively a view in longitudinal section on line VII—VII and a front view on line VIII—VIII, of a fourth embodiment of the present invention comprising a double gantry.
Figure 7:
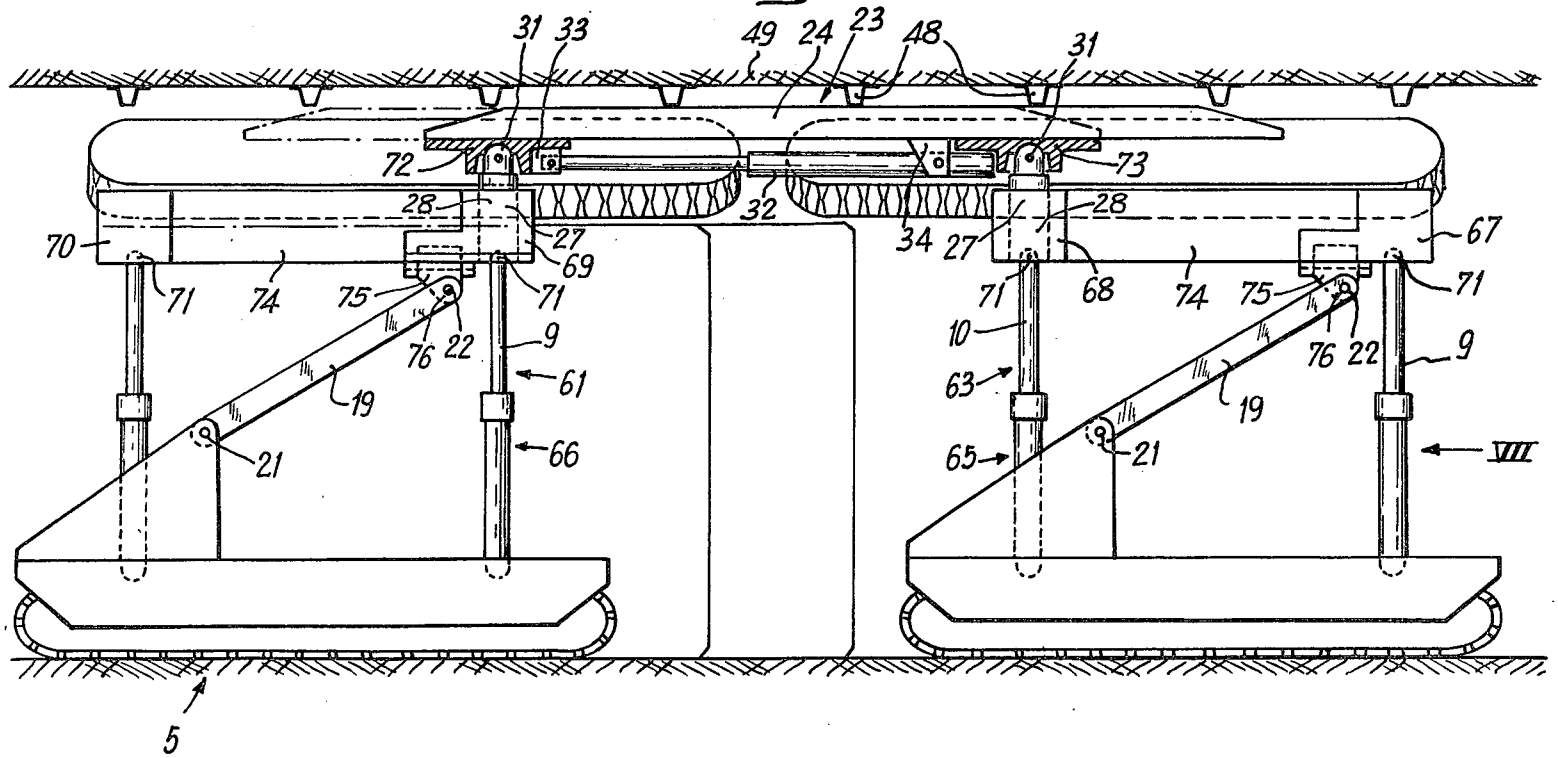

FIGS. 7 and 8 illustrate another embodiment of the present invention, in which four supporting units 61, 62, 63, 64, which are parallel two by two—61,62, and 63,64—constitute two single gantry supports 65, 66 aligned one behind the other. The lower and intermediate portions of these supports are identical to those of the previously described supports. The four props of the same support are connected by articulations 71 to a frame 60 comprising two longitudinal members 74 and two cross-members, that is to say respectively a cross-member 67 for the front props 9, a cross-member 68 for the rear props 10 of the first support 65 (on the right in FIG. 7), a cross-member 69 for the front props 9 and a cross-member 70 for the rear props 10 of the second support. Close to the front cross-member 67, 69 each frame carries an oscillating support 75 for a bearing 76 for the upper transverse pivotal articulation 22 of the connecting rod 19.

The cross-members 67 to 70 are arched, as in the preceding case, and the two cross-members 67, 68 and 69, 70 of the same support carry two upper frames 16 situated above the lower frames 5, these upper frames 16 comprising articulated tracks and having supporting faces 54 inclined in order to support the roof of an arched gallery 49, which may optionally be equipped with supporting arches 48. The cross-members of the same support are connected by longitudinal members 53. An intermediate upper frame 23 comprises a straight girder 24 which is supported on two slide guide members 72,73 of which one is carried by the rear cross-member 68 of the front support 65, as previously described, while the other is carried in the same manner by the front cross-member 69 of the rear support 66. A lower member 34 of the girder 24 is coupled to an end portion of a jack 32, the other end of which jack 32 is coupled to the slide guide support 72.

Figure 9:
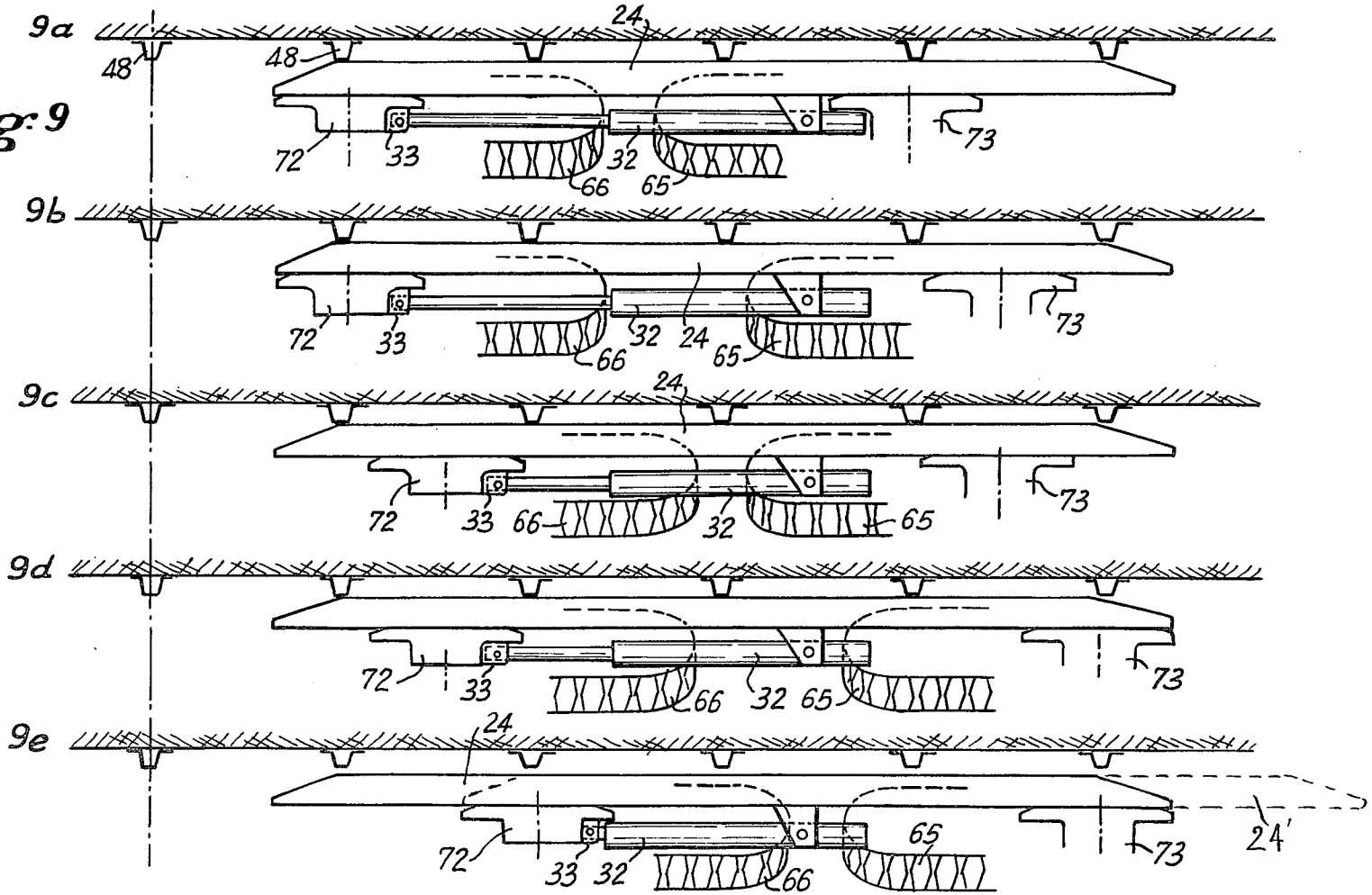
FIGS. 9*a*–9*e* are a diagram explaining the functions of the support shown in FIGS. 7 and 8 which occur in the course of its advance.

The method of operation of the double gantry support shown in FIGS. 7 and 8 is illustrated diagrammatically in FIG. 9. At the position shown in FIG. 9*a* the two supports are the closest to one another and the girder 24 is in the front end position. At the position shown in FIG. 9*b* the front support 65 has advanced, while the support 66 has not advanced; the girder 24, being clamped against the roof, remains there without advancing. At the position shown in FIG. 9*c* the front support 95 has not moved, but the support 66 has advanced. The girder 24, being clamped against the roof, has remained there and is thus behindhand in respect of advance relative to the supports, while the jack 32 has retracted halfway, either through connection to a reservoir or through active operation. The advance of the gantry support 65 can be repeated (FIG. 9*d*), followed by the advance of the gantry support 66 (FIG. 9*c*), until the jack 32 is completely retracted to the end position. At that moment it is sufficient to release the upper frame 23 by retracting the small vertical jacks 28 and then extending the jack 32, thereby advancing the girder 24, which is relieved of load and freed of all support on the roof at 24', after which the jacks 28 are placed under load again, and the position shown in FIG. 9*a*, for the commencement of a new cycle, is thus reached again.

In the third and fourth embodiments arched cross-members 50, 51 and 67 and 68 have been shown, which carry tracked frames mounted in oblique positions. These frames could equally be sliding beams as in the embodiment shown in FIGS. 3 and 4, but mounted on arched cross-members.

We claim:

1. A roof support in the form of a gantry for supporting a roof of a passage and advanceable along a floor of such passage, the support comprising:

(a) at least three parallel upper frames including two lateral frames and at least one intermediate frame, at least one of which frames comprises a straight beam;

(b) at least two lower frames each provided with an articulated track;

(c) jack means operable to clamp at least one of the upper frames against the roof of the passage;

(d) means for transmitting advancing forces of the support from the lower frames to the upper frames;

(e) at least two cross-members extending between the lateral frames and carrying the upper frames;

(f) guide means carried by the cross-members and supporting the at least one beam for slidable displacement thereof longitudinally of the support when said one beam is clamped to the roof between the rock and said guide means; and (g) means for sliding the at least one beam.

2. A support according to claim 1, wherein the guide means comprises aligned elements carried by the cross-members.

3. A support as claimed in claim 1 comprising means to push upwards the guide means by a vertical push-rod means sliding in said cross-member.

4. A support according to claim 3, wherein the pushing means comprises jack means.

5. A support according to claim 4, comprising push-rod means operable by the jack means and connected to the guide means by spherical articulation means.

6. A support according to claim 1, wherein all the upper frames comprise slidable straight beams each supported on a respective longitudinal guide of the guide means.

7. A support according to claim 6, wherein the jack means is so controllable that at least one of two adjacent upper frames will at all times during operation be clamped against the roof.

8. A support according to claim 1, wherein the lateral upper frames comprise frame members having rounded ends and articulated tracks.

9. A support according to claim 1, wherein the cross-members are arched transversely of the support.

10. A support according to claim 1, comprising an odd number of upper frames.

11. A support according to claim 1, comprising two gantries aligned one behind the other and coupled together and each including at least two cross-members, wherein the at least one intermediate upper frame is common to the two gantries and the guide means comprises elements carried by one of the cross-members of each gantry.

* * * * *